United States Patent [19]

Ojima et al.

[11] 4,254,488

[45] Mar. 3, 1981

[54] ANALOG ELECTRONIC TIMEPIECE

[75] Inventors: Shin Ojima, Yao; Kazuhiko Ohgami, Hanazono; Atsuhi Hisazumi, Yao, all of Japan

[73] Assignee: Hoshidenki-Seizo Kabushiki Kaisha, Osaka, Japan

[21] Appl. No.: 78,271

[22] Filed: Sep. 24, 1979

Related U.S. Application Data

[63] Continuation-in-part of Ser. No. 908,417, May 22, 1978, abandoned.

[30] Foreign Application Priority Data

| | | | |
|---|---|---|---|
| May 25, 1977 | [JP] | Japan | 52/68083[U] |
| Nov. 11, 1977 | [JP] | Japan | 52/152181[U] |
| Jun. 23, 1979 | [JP] | Japan | 54/86294[U] |
| Jul. 5, 1979 | [JP] | Japan | 54/93321[U] |
| Jul. 9, 1979 | [JP] | Japan | 54/94301[U] |

[51] Int. Cl.[3] ..... G04G 9/04

[52] U.S. Cl. ..... 368/82; 368/240

[58] Field of Search ..... 368/29, 82, 239–241

[56] References Cited

U.S. PATENT DOCUMENTS

| | | | |
|---|---|---|---|
| 3,276,200 | 10/1966 | Freeman | 368/240 |
| 4,103,208 | 7/1978 | Washizuka | 313/513 |

*Primary Examiner*—Edith S. Jackmon

*Attorney, Agent, or Firm*—Pollock, Vande Sande & Priddy

[57] ABSTRACT

Sixty strip-like phosphor display elements are formed on an insulated substrate to extend radially from its center at equiangular intervals, and inner and outer grids are disposed substantially concentrically with the radially extending phosphor display elements in opposing relation thereto. A thermo-electron emissive heater is disposed in opposing relation to the inner and outer grids on the opposite side from the phosphor display elements. A drive-display circuit provides, on a time-shared basis, a short hand display by selecting one of the phosphor display elements corresponding to an hours signal and applying a voltage to the inner grid alone, and provides a long hand display by selecting one of the phosphor display elements corresponding to a minutes signal and applying voltages to both the inner and outer grids.

11 Claims, 13 Drawing Figures

ANALOG ELECTRONIC TIMEPIECE

CROSS REFERENCE TO RELATED APPLICATION

This application is a continuation-in-part of our prior copending U.S. Application Ser. No. 908,417 filed May 22, 1978, for "Analog Electronic Timepiece", which is now abandoned.

BACKGROUND OF THE INVENTION

This invention relates to an analog electronic timepiece which is designed to provide a time display in the same manner as a conventional watch or clock which uses short and long hands to designate hours and minutes respectively.

Most conventional electronic timepieces directly display time in the form of numerals. This method of display is convenient for merely reading the time, but a time display by hands as in a conventional analog timepiece is more suitable for intuitively reading the time interval from the current time to a certain time. From this point of view, it has been proposed heretofore that electronic timepieces employ the same method of display as that using hands.

In one form of analog electronic timepiece, heretofore proposed, a display element disposed on an extension line of another display element, and at a distance therefrom, is used to provide a short hand display to designate hours, and both display elements are simultaneously selected to provide a long hand display to display minutes. In this known arrangement, the long hand display is not produced as one continuous line, i.e., the long hand display is discontinuous, and hence is likely to cause misinterpretation. In another known form of analog electronic timepiece, the short and long hand displays are provided by using entirely different display elements, and a large number of display elements is accordingly required which introduces much difficulty in the manufacture of the timepiece. Further, these known analog electronic timepieces provide a minutes and hours display alone, and do not provide a seconds display. However, electronic timepieces, in particular those employing a crystal oscillator, are very accurate and lend themselves to the producing of an accurate seconds display.

An object of this invention is to provide an analog electronic timepiece which employs a small number of display elements, and which is capable of providing a long hand display in the form of one continuous line.

Another object of this invention is to provide an analog electronic timepiece which is capable of providing a seconds display in addition to the hours and minutes display, and which achieves these displays with a small number of display elements.

SUMMARY OF THE INVENTION

In accordance with this invention a phosphor display tube includes within its envelope sixty strip-like phosphor display elements which are disposed radially at equiangular intervals. The tube further includes an inner grid substantially concentric with the radially extending phosphor elements and disposed in opposing relation thereto, and an annular outer grid substantially concentric with the inner grid and disposed on the outside thereof. A thermoelectron emissive heater is provided within the tube in opposing relation to the inner and outer grids on the opposite side from the display elements.

An hours signal, a minutes signal and a seconds signal are repeatedly supplied from a time signal generator circuit to a drive-display circuit on a time-shared basis to appropriate ones of the display elements. When the hours signal is supplied, the one of the display elements is selected which corresponds to the hours signal and, at the same time, a voltage is applied to the inner grid alone, so that only that portion of the selected display element opposing the inner grid is energized to emit light, thus providing a short hand display. When the minutes signal is applied to the drive-display circuit, the one of the display elements is selected which corresponds to the minutes signal and, at the same time, voltages are applied to both the inner and outer grids, so that the selected display element opposing both grids is energized to emit light over its whole length, thus providing a long hand display. Since some of electrons from the heater are emitted obliquely, if the inner and outer grids are disposed as closely to each other as possible, the electrons also impinge on that portion of the selected display element opposite the gap between the inner and outer grids to cause that portion to emit light as well. Consequently, the long hand display is provided as one continuous line.

In a similar manner, when the seconds signal is supplied to the drive-display circuit, the one of the display elements is selected corresponding to the seconds signal and, at the same time, voltages are applied to both of the inner and outer grids to produce a long hand display.

DETAILED DESCRIPTION OF THE INVENTION

Figure 1:
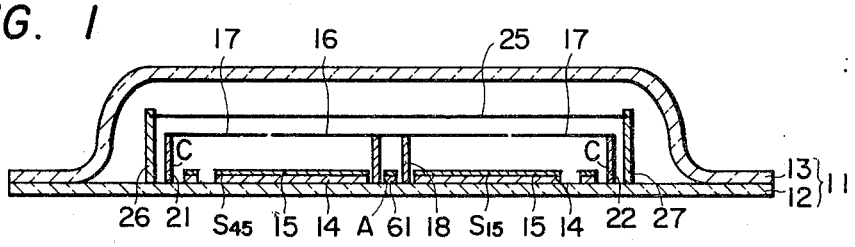
FIG. 1 is a cross-sectional view illustrating an example of a phosphor display tube for an analog electronic timepiece according to this invention.
Figure 2:
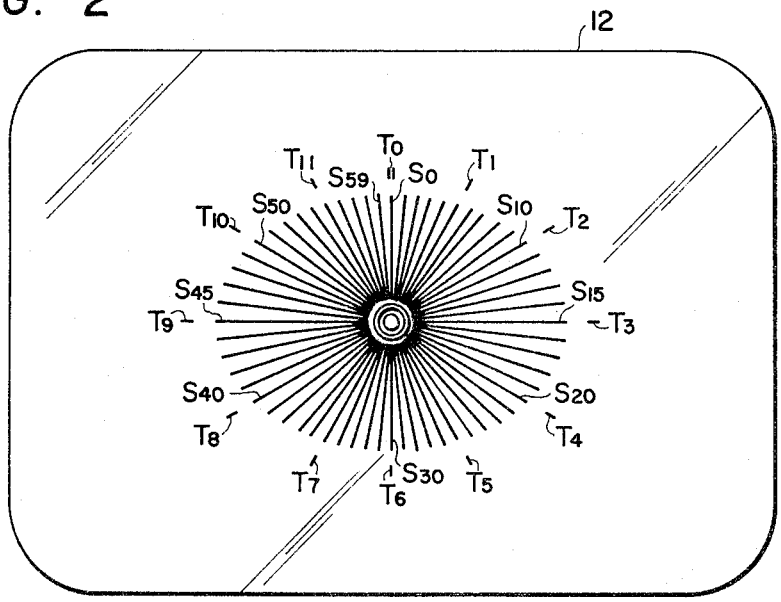
FIG. 2 is a plan view showing an insulated substrate used in the display tube of FIG. 1.

Referring first to FIG. 1, the timepiece of the present invention comprises a phosphor display tube having a flat, airtight envelope 11, at least the front side of which is made transparent. In the illustrated example, the rear panel of the envelope 11 is an insulated substrate 12 formed of glass, and a concave glass cover 13 is mounted on the insulated substrate 12, the marginal portions of the insulated substrate 12 and the glass cover 13 being fused together to provide the envelope 11. In the envelope 11, sixty strip-like phosphor display elements $S_0$ to $S_{59}$ are formed on one surface of the insulated substrate 12 to extend radially from its center at equiangular intervals, as shown in FIG. 2. The display elements $S_0$ to $S_{59}$ are each composed of an anode 14 formed on the insulated substrate 12, and a phosphor layer 15 deposited on the anode 14. On the outside of the circle of the arrangement of the display elements $S_0$ to $S_{59}$, two short display elements $T_0$ are provided in alignment with the display element $S_0$ to indicate 12 o'clock, and display elements $T_1$, $T_2$, $T_3$, . . . $T_{11}$ are similarly formed in alignment with the display elements $S_5$, $S_{10}$, $S_{15}$, etc., respectively to indicate one o'clock, two o'clock, three o'clock etc.

The tube further includes a disk-shaped inner grid 16 which is concentric with and disposed in opposing relation to the strip-like display elements $S_0$ to $S_{59}$ and, on the outside of the inner grid 16, and annular outer grid 17 is disposed in opposing relation to the display elements $S_0$ to $S_{59}$ in substantially the same plane as the inner grid 16. The inner and outer grids 16 and 17 are each provided in the form of a mesh fine enough to permit easy viewing of a display of the display elements from the front of the envelope, that is, from the side of the transparent cover 13. The inner and outer grids 16 and 17 are disposed as closely to one another as possible, e.g. the distance between them is selected to be about 0.5 mm. The boundary between the inner and outer grids 16 and 17 is selected to lie, for example, at a position about $\frac{1}{3}$ the entire length of each display element S from its outer end.

Figure 3:
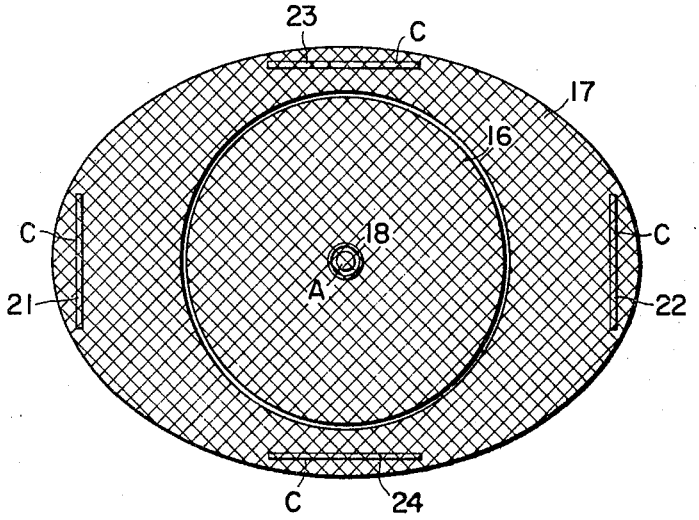
FIG. 3 is a plan view showing a grid utilized in the display tube of FIG. 1.

In the illustrated example (see especially FIG. 3), the grids are elliptical in shape as a whole, and the circular inner grid 16 is positioned at the central part of the ellipse. Mounted on the substrate 12, at the center from which the strip-like display elements radially extend, is a cylindrical support 18 on which the inner grid 16 is fixedly supported. The cylindrical support 18 also serves as a lead for the application of a voltage to the inner grid 16. At the right and left-hand ends of the outer grid 17, support pieces 21 and 22 are mounted on the substrate 12 to extend in the vertical direction of FIG. 3, and support pieces 23 and 24 are mounted on the substrate 12 to extend in the lateral direction of FIG. 3 at the upper and lower ends of the outer grid 17. The outer grid 17 is supported on these support pieces 21 through 24.

Figure 4:
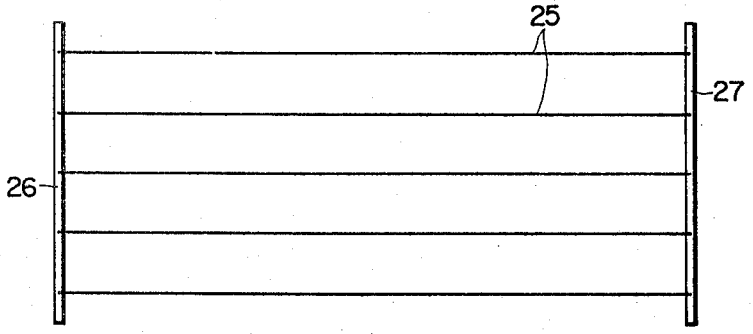
FIG. 4 is a plan view showing a heater employed in the display tube of FIG. 1.

On the side of the grids opposite to the display elements, a thermoelectron emissive heater 25 is disposed in opposing relation to the inner and outer grids 16 and 17. Outside of and adjacent to the grid support pieces 21 and 22, a pair of heater support pieces 26 and 27 are mounted on the substrate 12 to extend in the vertical direction of FIG. 4. Between the support pieces 26 and 27 heating wires 25 are stretched at substantially equal intervals. On the substrate 12, leads 28 for the respective strip-like display elements $S_0$ to $S_{59}$ are wired and, though not shown, leads are also wired for the display elements $T_0$ to $T_{11}$, the grids 16 and 17, and the heater 25.

For an hours display, one of the strip-like display elements $S_0$ to $S_{59}$ is selected and supplied with a voltage, and only the inner grid 16 is supplied with a voltage so that, as a result, only that portion of the selected strip-like display element corresponding to the inner grid 16 is energized to radiate, thereby providing a short hand display. For a minutes display, one of the strip-like display elements $S_0$ to $S_{59}$ is selected and supplied with a voltage, and the inner and outer grids 16 and 17 are both supplied with voltages so that, as a result, the selected strip-like display element is energized to emit light to produce a long hand display. For a seconds display, one of the strip-like display elements $S_0$ to $S_{59}$ is selected, and both grids 16 and 17 are supplied with voltages to provide a long hand display, as in the case of the minutes display. The hours, minutes and seconds displays are achieved within a period of time sufficiently shorter than 1 second, so that these displays appear visually to have been produced simultaneously. The display elements $T_0$ to $T_{11}$ are always supplied with voltages and emit light only when a voltage is applied to the outer grid 17, and this appears visually as a stationary or fixed display.

Figure 5:
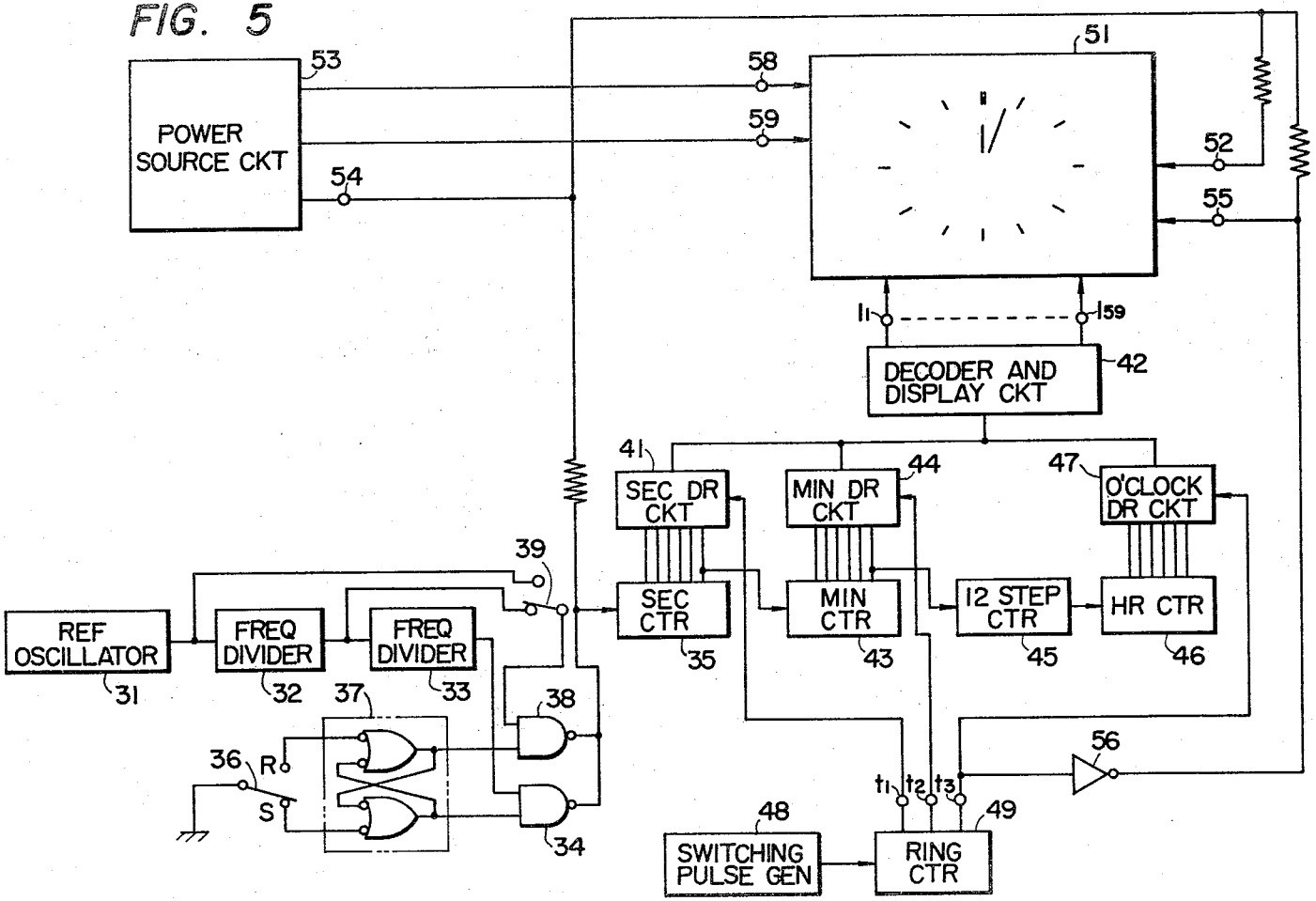
FIG. 5 is a block diagram illustrating an example of an electrical circuit for use in the analog electronic timepiece of the present invention.

Turning now to FIG. 5, a description will be given with regard to an example of a drive-display circuit for the phosphor display tube described above in respect of FIGS. 1 through 4.

Clock pulses having a period of 0.01 second are supplied by a reference oscillator 31, such as a crystal oscillator or an oscillator synchronized with the commercial power source, and are frequency divided by a frequency divider 32 whose output, having a period of 0.1 second, is further frequency divided by a frequency divider 33 to provide clock pulses having a period of 1 second. The output thus obtained is provided via a NAND gate 34 to a 60-step seconds counter 35. When a switch 36 for resetting the time piece is turned to the side thereof designated S, a flip-flop 37 is set to open the NAND gate 34 while closing a NAND gate 38. When the switch 36 is turned to the side thereof designated R, the flip-flop 37 is reset to close the gate 34 while opening the gate 38. At this time, if a switch 39 is connected to the side thereof designated F, the output from the oscillator 31 is applied via the gate 38 to the seconds counter 35 to reset the time piece at a high speed. Conversely, if the switch 39 is connected to the side thereof designated L, the output from the frequency divider 32 is supplied via the gate 38 to the seconds counter 35 to achieve resetting of the time piece at a low speed.

The count content of the seconds counter 35 is provided via a seconds drive circuit 41 to a decoder and display circuit 42. A carry pulse of the seconds counter 35 or a pulse occurring every minute is applied to a 60-step minutes counter 43, whose count content is, in turn, supplied via a minutes drive circuit 44 to the decoder and display circuit 42. Pulses each emanating from the minutes counter 43 every minute are counted by a 12-step counter 45 to derive therefrom a pulse every five minutes. The pulses, each occurring every five minutes, are counted by a 60-step hours counter 46, and its count content is provided via an o'clock drive circuit 47 to the decoder and display circuit 42.

There is provided a switching pulse generator 48 which oscillates at a frequency of 10 KHz, for instance, and its output is applied to a 3-bit ring counter 49, and the outputs derived at its output terminals $t_1$, $t_2$ and $t_3$ are supplied to chip selecting terminals of the seconds, minutes and o'clock drive circuits 41, 44 and 47, respectively. Only while supplied at their chip selecting terminals with pulses, respectively, these drive circuits are each operative to apply the count content of the corresponding counter to the decoder and display circuit 42.

Output terminals $I_0$ through $I_{59}$ of the decoder and display circuit 42 are respectively connected to the strip-like display elements $S_0$ through $S_{59}$ of a phosphor display tube 51 constructed as described previously in connection with FIGS. 1 to 4. A terminal 52 for the inner grid 16 is always supplied with a voltage from a terminal 54 of a power source circuit 53. A terminal 55 for the outer grid 17 is connected to the power source terminal 54 and, at the same time, the ring counter 49 terminal $t_3$ for selecting the hours drive circuit 47 is also connected via an inverter 56 to the power source terminal 54. Accordingly, when the o'clock drive circuit 40 is operating, the outer grid 17 becomes low in potential level and, in the other cases, the outer grid 17 becomes high in level. A terminal 58 for the thermolectron emissive heater 25 of the phosphor display tube 51 and a terminal 59 for the display elements $T_0$ through $T_{11}$ are respectively supplied with required voltages from the power source circuit 53. Further, power for actuating each circuit is supplied thereto from the power source circuit 53.

Figure 6:
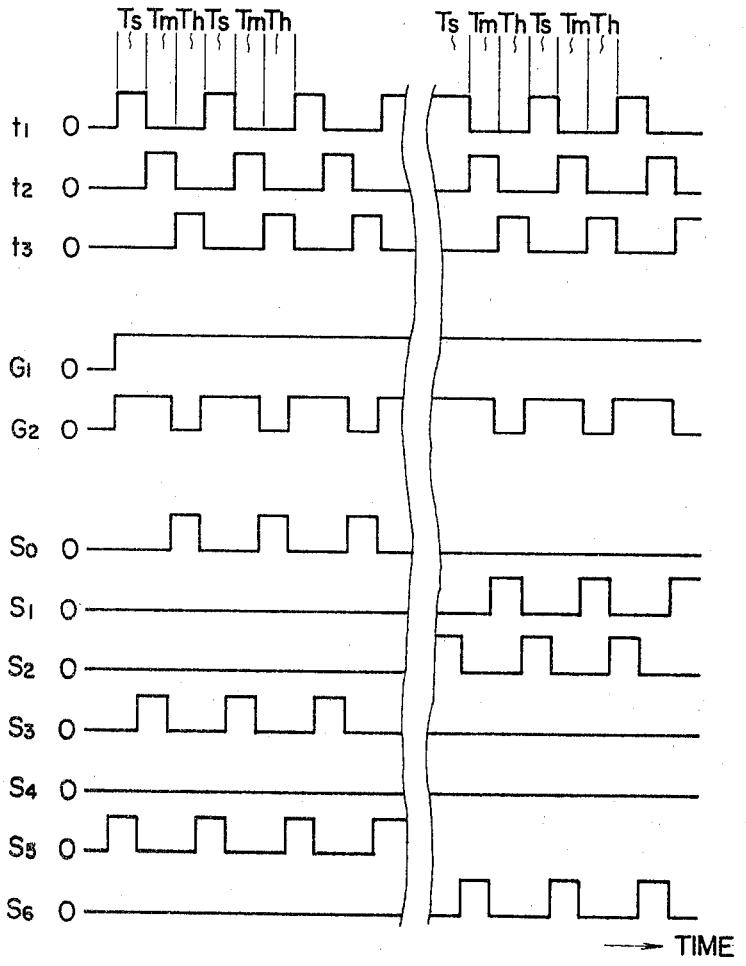
FIG. 6 is a timing chart explanatory of the operation of the electrical circuit shown in FIG. 5.

For instance, as shown in FIG. 6, pulses are sequentially derived from the terminals $t_1$, $t_2$ and $t_3$ of the ring counter 49, by which the seconds, minutes and o'clock drive circuits 41, 44 and 47 are repeatedly made operative one after another, with the result that seconds, minutes and hours display periods $T_s$, $T_m$ and $T_h$ occur in a repeating cyclic order. The inner grid 16 has a high level at all times, as indicated by $G_1$ in FIG. 6, but the outer grid 17 is, as indicated by $G_2$ in FIG. 6, low in level when the o'clock drive circuit 46 has a high level, i.e. in the hours display period $T_h$, and is high in level in the other periods.

For displaying the time 0:03.5., for example, the terminal $T_1$ becomes high in level in the seconds display period $T_s$ and the seconds drive circuit 41 is driven and, at this time, the count content of the seconds counter 35 is "5", and a voltage is applied to the display element $S_5$, energizing it to radiate over its whole length. In the next minutes display period $T_m$, the terminal $t_2$ becomes high in level, and the minutes drive circuit 44 becomes operative. At this time, the count content of the minutes counter 43 is "3", and a voltage is applied to the display element $S_3$, also causing it to radiate over its whole length. In the next hours display period $T_h$, the terminal $t_3$ becomes high in level, and the hours drive circuit 47 is driven. At this time, the count content of the hours counter 46 is "0" and a voltage is applied to the display element $S_0$. In this instance, since the outer grid 17 is not supplied with a voltage and hence remains low in level, only that portion of the display element $S_0$ which is opposite to the inner grid 16 emits light to provide a short hand display. In this manner, the seconds, minutes and hours displays corresponding to the time 0:03.5. are switchingly provided. Since the switching is carried out at a speed higher than the seconds signal, the transient state of the seconds display is also provided. The display of the time 0:03.5. is shown on the phosphor display tube 51 in FIG. 5, except for the seconds display.

In the right half of FIG. 6, there are illustrated waveforms appearing at the respective parts to display the time 1:06.2.

In the above embodiment, a seconds display is produced, but this may be omitted. That is, the seconds drive circuit 41 can be left out, and a binary counter is used in place of the ring counter 49. In this form of the invention, when only the hours display is present it is unclear whether the timepiece is actually operating or not. Therefore, a dot-like display element 61 is provided on the substrate 12 in the support 18, as shown in FIG. 1, and, for example, the output from the frequency divider 32 is branched and applied to the dot-like display element 61. Thus the dot-like display element 61 is continually turned ON and OFF every 0.1 seconds to indicate that the timepiece is in operation.

The display surface need not be elliptical in shape as a whole but may be of a circular or any other configuration. Also, the display elements $T_0$ through $T_{11}$ need not always be light-emissive.

As has been described above, in the analog electronic timpiece of this invention, since the display elements $S_0$ through $S_{59}$ are employed to provide both the hours and the minutes display, the manufacture of the timepiece is easier than those timepieces which employ separate display elements for the hours and minutes display respectively. Moreover, even though the inner and outer grids 16 and 17 are spaced from one another, and the long hand display is produced by applying voltages to both of the inner and outer grids 16 and 17, the distance between the grids is small and the electrons from the heater 25 include those emanating therefrom obliquely, so that the electrons also reach that portion of the strip-like display element corresponding to the gap between the inner and outer grids 16 and 17, and the strip-like display element continuously emits light over its whole length. The seconds display can also be achieved in the same manner as described above.

In the foregoing embodiment, the external terminals $I_0$ to $I_{59}$ are individually connected to the sixty strip-like phosphor display elements $S_0$ to $S_{59}$, but such a large number of external terminals is a great obstacle to miniaturization of the timepiece. This problem can be solved by the following arrangement: Each grid is divided at substantially equiangular intervals into a plurality of segments, and the display elements corresponding to each segment are each connected to a corresponding one of the display elements corresponding to each of the other segments so that the number of external terminals is reduced to the number that the number of the display elements, i.e. 60, is divided by the number of segments.

Figure 7:
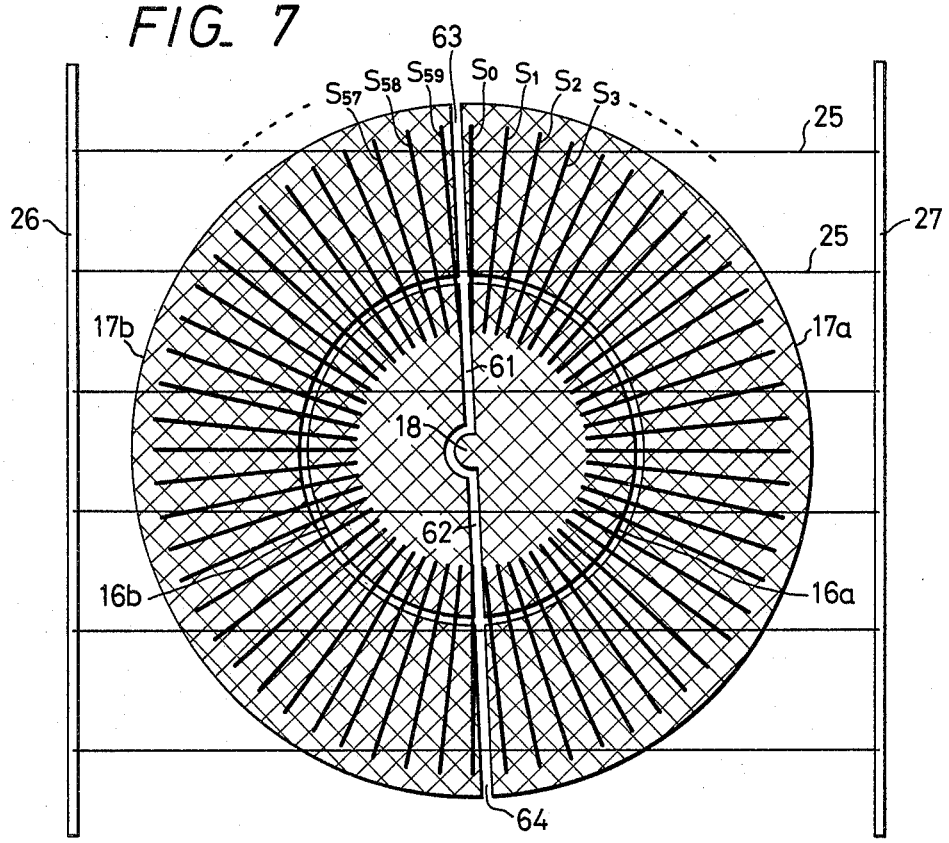
FIG. 7 is a plan view showing, with its cover removed, another example of the timepiece of the present invention in which inner and outer grids are each divided into two.
Figure 8:
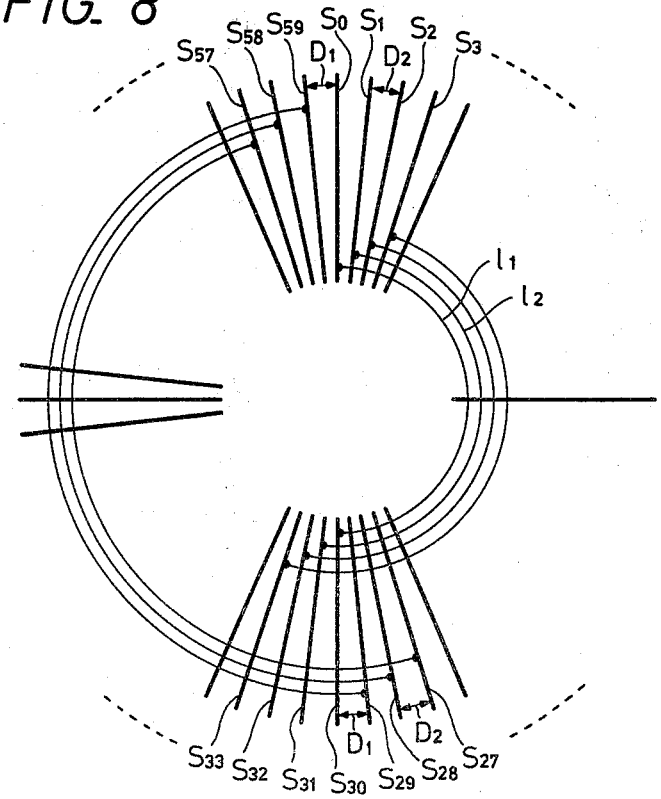
FIG. 8 is a plan view illustrating connections of strip-like display elements used in the example of FIG. 7.

An example of such an arrangement is shown in FIGS. 7 and 8, in which parts corresponding to those in FIGS. 1 to 4 are identified by the same reference numerals. As shown in FIG. 7, the inner grid 16 is divided at an angular interval of 180° about the cylindrical support 18 into two segments **16*a* and 16*b*, and the outer grid 17 is similarly divided at an angular interval of 180° into segments 17*a* and 17*b* of the same number as the segments 16*a* and 16*b*. In this case, the spaces or gaps between the segments 16*a* and 16*b* of the inner grid 16 and between the segments 17*a* and 17*b* of the outer grid 17 are aligned, as indicated by 61, 62, 63 and 64**.

As illustrated in FIG. 8, the strip-like display elements $S_0$ to $S_{59}$ are connected in such a manner that diametrically opposite ones of them are respectively combined to make pairs; in other words, the display elements on the side of each of the grid segments 16*a* and 16*b* are each connected to the display element on the side of the other segment which is spaced apart an angular distance of 180°. For example, the display elements $S_0$ and $S_{30}$, and those $S_1$ and $S_{31}$ are interconnected via leads $l_1$ and $l_2$, respectively. Likewise, the other display elements are also connected in pairs, and one of the two interconnected display elements underlies, for example, the grid segment 16*a* and the other underlies the other grid segment 16*b*.

It is preferred that the display element spacing at the gap between the grid segments be selected larger than the display element spacing at other places. In FIG. 8, the distance $D_1$ between the display elements $S_0$ and $S_{59}$ and between $S_{29}$ and $S_{30}$ at the gaps 63 and 64 respectively is selected larger than the distance $D_2$ between the other adjacent display elements.

Figure 9:
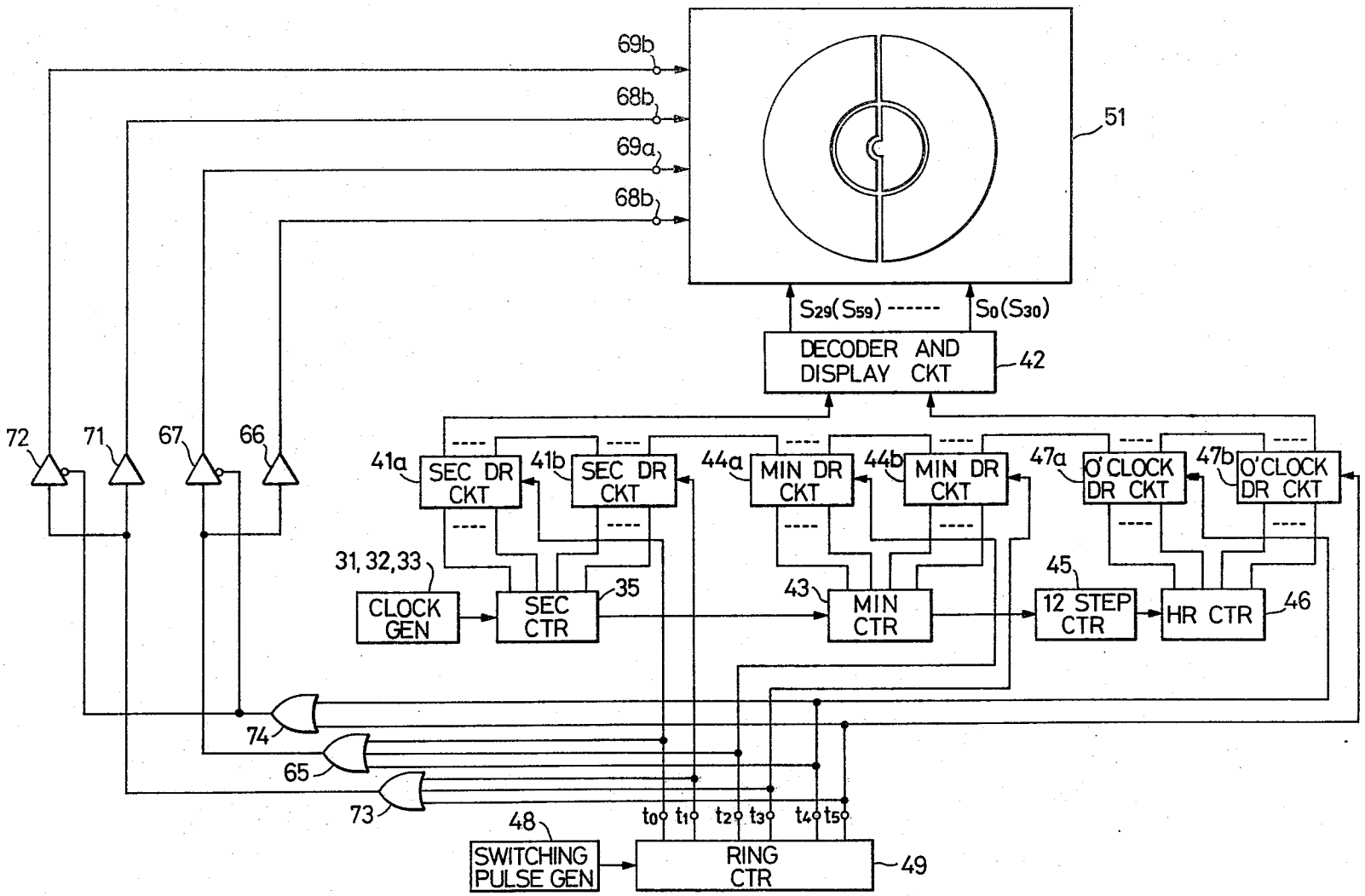
FIG. 9 is a block diagram showing an example of a drive-display circuit for the phosphor display tube depicted in FIG. 7.

For providing a display of the time with such an arrangement, a voltage is applied only to the grid segment which corresponds to the display element to be energized by the time signal. A specific operative example of a drive-display circuit therefor is illustrated in FIG. 9, in which like reference numerals are used to indicate the same parts as those in FIG. 5. In the illustrated example, the seconds drive circuit 41, the minutes drive circuit 44 and the o'clock drive circuit 47 are respectively divided into two corresponding to the number of grid segments used, i.e. seconds drive circuits 41*a* and 41*b*, minutes drive circuits 44*a* and 44*b*, and o'clock drive circuits 47*a* and 47*b*. Outputs of 0 to 29 seconds and outputs of 30 to 59 seconds from the seconds counter 35 are applied to the seconds drive circuits 41*a* and 41*b* respectively. Outputs of 0 to 29 minutes and outputs of 30 to 59 minutes from the minutes counter 43 are applied to the minutes drive circuits 44*a* and 44*b* respectively. Outputs of 0:00 to 5:48 and outputs of 6:00 to 11:48 from the hours counter 46 are applied to the o'clock drive circuits 47*a* and 47*b* respectively.

The output terminals $I_0$ to $I_{29}$ of the decoder and display circuit 42 are respectively connected to the terminals $I_{30}$ to $I_{59}$, and these pairs of output terminals are respectively connected to thirty external terminals of the strip-like display elements $S_0$ to $S_{59}$ of the phosphor display tube. A 6-step counter is employed as the ring counter 49, and its six output terminals $t_0$ to $t_5$ are respectively connected to chip select terminals of the drive circuits 41*a*, 41*b*, 44*a*, 44*b*, 47*a* and 47*b*.

For example, when the potential at the terminal $t_0$ becomes high-level, only the drive circuit 41*a* becomes operative, and signals of 0 to 29 seconds from the seconds counter 35 are provided to the decoder and display circuit 42. At this time, the output at the terminal $t_0$ is applied via an OR circuit 65 to drive circuits 66 and 67, whose outputs are respectively provided via terminals 68*a* and 69*a* to the grids 16*a* and 17*a*. Accordingly, in this case, when the counter 35 provides a signal representing any one of 0 to 29 seconds, one of the display elements corresponding to this signal is selected and energized to radiate since voltages are also applied to the grids 16*a* and 17*a* at this time. In this case, however, drive circuits 71 and 72 for the grids 16*b* and 17*b* are not driven, so that the display element connected to the selected one and disposed opposite the grid 16*b* is not energized.

In a similar manner, when the potential at the terminal $t_1$ becomes high-level, the drive circuit 41*b* is selected, and drive circuits 71 and 72 are driven via an OR gate 73, applying voltages to the grids 16*b* and 17*b* via terminals 68*b* and 69*b* respectively. As a consequence, only a selected one of the display elements disposed opposite the grids 16*b* and 17*b* is energized to radiate. Outputs at terminals $t_2$ and $t_3$ are respectively supplied to the OR gates 65 and 73, by which the drive circuits 44*a* and 44*b* are selected to provide a minutes display. When the output from the hours counter 46 is selected, outputs at terminals $t_4$ and $t_5$ are applied to the OR gates 65 and 73 and, at the same time, supplied to an OR gate 74, whose output is applied to the drive circuits 67 and 72 to inhibit their driving. As a result of this, the outer grid 17 is not driven, but only the inner grid 16 is driven, and only that portion of the display element underlying the inner grid is caused to radiate, producing a short hand display.

Since the inner and the outer grids are each divided, and since the display elements are disposed in close proximity, there is the possibility that the electrons emanating from the heater cannot sufficiently be controlled at the gaps (61, 62 or 63, 64) between the grids; but in the embodiment shown in FIG. 7, the display element spacing $D_1$ at the gap between the grid segments is selected large, as described previously, so that unnecessary radiation of the display element by electrons passing around behind it can be prevented.

In the above embodiments the inner and the outer grids are each divided into two at an equiangular interval, but they can be divided into more segments. It is also possible to increase the display element spacing only at the gap between the inner grid segments where it is difficult to control the electrons from the heater.

Figure 10:
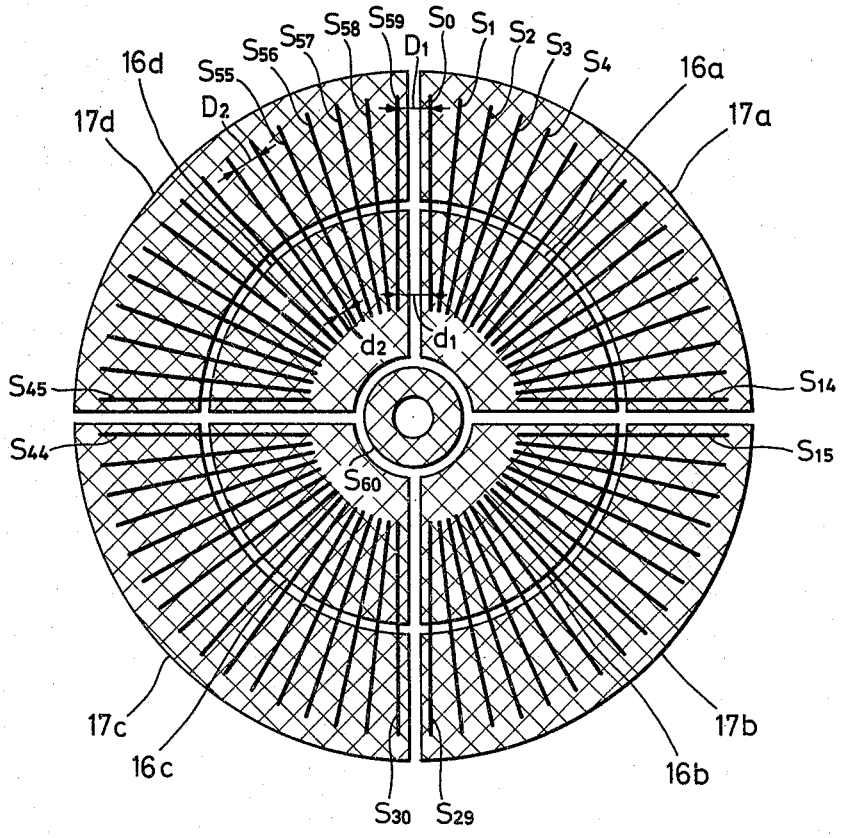
FIG. 10 is a plan view showing, with its cover removed, a further example of the timepiece of the present invention in which inner and outer grids are each divided into four.

For example, as shown in FIG. 10, the inner grid 16 is divided at 90° intervals into four segments 16*a* through 16*d*, and the outer grid 17 is also divided at 90° intervals into four segments 17*a* to 17*d*. The display elements $S_0$ to $S_{59}$ are arranged opposite the outer grid 17 at exactly equiangular intervals, so that the display element spacing $D_1$ at each gap between the outer grid segments is equal to the spacing $D_2$ at other places where no such gaps exist; however, the display element spacing $d_1$ at each gap between the inner grid segments is selected larger than the display element spacing $d_2$ at other places where no such gaps exist. To this end, that surface area of an insulating substrate which underlies the inner grid is divided at equiangular intervals into sixty-four equal parts, and at four positions where the inner grids are divided, the inner portions of the display elements are spaced apart an angular distance including two of the abovesaid sixty-four equal parts, whereas at the positions where the inner grid is not divided, the inner parts of the display elements are spaced apart an angular distance corresponding to one of the sixty-four equal parts. Needless to say, the inner portion of each display element underlying the inner grid is formed in alignment with the outer portion of the same display element underlying the outer grid. Consequently, the difference between the display element spacings $D_1$ and $d_1$ at the grid dividing position is smaller than the difference between the distances $D_2$ and $d_2$ at the other positions.

Figure 11:
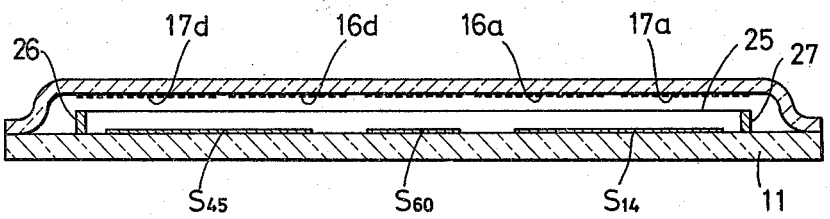
FIG. 11 is a cross-sectional view showing another example of the phosphor display tube for use in the present invention.

Any grid structures may be employed so long as electrons from the heaters can be controlled to impinge on the display elements. Accordingly, it is also possible to dispose the heaters 25 directly above the strip-like display elements and to dispose the grids 16 and 17 in opposing relation to the strip-like display elements across the heater 25, as depicted in FIG. 11. In this case, when it is necessary to prevent radiation of the display elements, the grids 16 and 17 are made sufficiently positive so that the electrons from the heaters 25 are almost absorbed by the grids and do not reach the display elements, whereas when it is desired to provide a display by radiation of the display elements, the grids 16 and 17 are made zero-potential or negative so that the electrons from the heaters 25 impinge on the display elements. In the case where the grids 16 and 17 are positioned on the opposite side from the display elements $S_0$ to $S_{59}$ with respect to the heaters 25, as in the case of FIG. 11, the grids 16 and 17 can be formed by evaporization of transparent electrodes on the inside of the cover 13 of the airtight envelope 11, as shown in FIG. 11.

When the grids are each divided at equiangular intervals as in the examples of FIGS. 7, 8 and 10, a complicated grid support structure is needed to support the grids in a manner to permit easy viewing of the display, and this makes it difficult to support the grids in a manner to withstand shocks. Further, in order to ensure that the electrons are uniformly controlled to be directed to and focused on the display elements to prevent variation of the brightness of the display, it is desirable to arrange the grids 16 and 17 flush with each other; but when the grids are each divided into segments, it is difficult to dispose them in the same plane due to the grid support structure. With the arrangement shown in FIG. 11, however, the grids 16 and 17 can easily be supported flush with each other.

Figure 12:
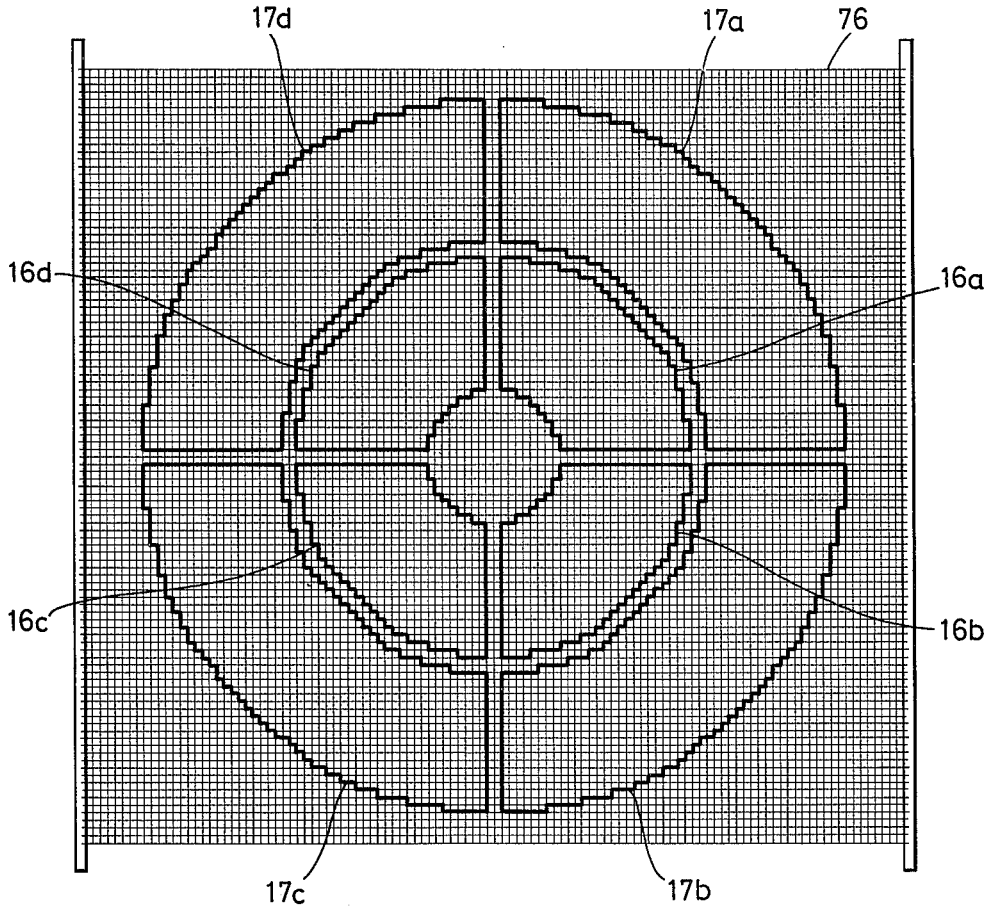
FIG. 12 is a plan view showing a still further example of the grid structure.
Figure 13:
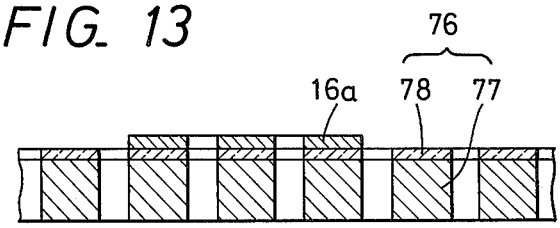
FIG. 13 is a partially enlarged view of FIG. 12.

In view of the above, the grids 16 and 17 can also be constructed as follows: As shown in FIG. 12 and FIG. 13 which shows, in cross-section, one part of FIG. 12 on an enlarged scale, patterns are formed of an electrode material or the like on a net 76 of an electrically insulating material, and the patterns are used as the inner grids 16*a* to 16*d* and the outer grids 17*a* to 17*d*. The net 76 may also be the insulating material itself, or an insulating film 78 may be formed on the surface of a wire netting 77, e.g. of molybdenum, by printing, evaporation or the like of tantalum or like insulating material, or oxidation of the wire netting itself, or deposition of a high molecular material, as depicted in FIG. 13. Then, the grids are formed in desired patterns by printing of a conductive material or evaporation of a metal on the insulating film 78. In this case, care must be taken to assure that meshes of the net are not closed.

With such a structure, even if the divided grids are complicated in shape and large in number, they can be supported only by supporting the support net 76 using a pair of simple support pieces e.g. such as 26 and 27 for the heater 25. Moreover, the plurality of grids can be held in the same plane, and leads for the grids can also be formed on the support net 76 at the same time.

It will be apparent that many modifications and variations may be effected without departing from the scope of the novel concepts of this invention.

What is claimed is:

1. An analog electronic timepiece comprising:

an airtight envelope having a front panel and a rear panel, at least said front panel being transparent;

sixty strip-like phosphor display elements formed in the airtight envelope on its said rear panel to radially extend from a central position on said rear panel at equiangular intervals;

an inner grid disposed opposite the strip-like phosphor display elements and substantially concentrically therewith;

an annular outer grid disposed in substantially the same plane as the inner grid on the outside thereof and in opposing relation to the strip-like phosphor display elements;

a thermoelectron emissive heater disposed in opposing relation to the inner and outer grids on the opposite side from the strip-like phosphor display elements;

means for generating a time signal;

a minutes drive circuit supplied with a minute signal included in said time signal;

an o'clock drive circuit supplied with an hours signal included in said time signal;

a decoder and display circuit supplied with the outputs from the minutes drive circuit and the o'clock drive circuit to select the ones of the sixty display elements which correspond to the supplied signals;

a selecting signal generator circuit for generating a selecting signal to render the minutes drive circuit and the o'clock drive circuit operative and to supply the decoder and display circuit with signals corresponding to the operative states of the minutes drive circuit and the o'clock drive circuit, the selecting signal being applied to the minutes drive circuit and the o'clock drive circuit alternatively with each other; and a circuit for providing a long hand display by applying voltages to both said inner grid and said outer grid at least upon generation of the selecting signal to the minutes drive circuit to illuminate one of the display elements over its entire length in response to the minutes signal, and for providing a short hand display by inhibiting the application of voltage to said outer grid with the selecting signal to the o'clock drive circuit but permitting the application of voltage to said inner grid alone to illuminate one part of one of the display elements in response to the hours signal.

2. An analog electronic timepiece according to claim 1, including a seconds drive circuit supplied with a seconds signal included in said time signal, said selecting signal generator circuit being operative to generate a selecting signal to the seconds drive circuit and the selecting signals to the minutes drive circuit and to the o'clock drive circuit on a time-shared basis.

3. An analog electronic timepiece according to claim 1, wherein additional phosphor display elements indicating hours are formed on said rear panel on the outside of said radially extending display elements at positions corresponding to twelve, one, . . . eleven o'clock, respectively, and means for supplying said additional phosphor display elements with energizing voltages at all times.

4. An analog electronic timepiece according to claim 1, wherein an additional phosphor display element is provided on said rear panel for indicating the operating status of the timepiece, and means for supplying said additional phosphor display element with an ON-OFF signal having a repetition rate higher than that of said minute signal.

5. An analog electronic timepiece comprising:

an airtight envelope having at least its front panel made transparent;

sixty strip-like phosphor display elements formed in the airtight envelope on its rear panel to radially extend at equiangular intervals, each of said display elements being connected to at least one other of said display elements;

a thermoelectron emissive heater disposed in opposing relation to the strip-like phosphor display elements;

an inner grid disposed in opposing relation to the strip-like phosphor display elements, said inner grid being divided at equiangular intervals about the center of radial extension of the phosphor display elements into the same number of grid segments as the interconnected ones of the phosphor display elements, and being capable of controlling the thermoelectrons from said heater which reach said phosphor display elements;

an outer grid disposed in substantially the same plane as the inner grid segments on the outside of them, said outer grid being divided into segments at the same angular positions as the inner grid, having a flat ring-like configuration in its entirety, and being capable of controlling the thermoelectrons from the heater which reach the phosphor display elements; and a drive-display circuit for selecting at least two interconnected ones of the phosphor display elements in response to an o'clock signal included in a time signal and controlling voltages to the inner and the outer grids so that the thermoelectrons from the heater are directed to that one of the selected phosphor display elements underlying only one of the inner grid segments to light one portion of said one phosphor display element, thereby to provide a short hand display, and for selecting two or more interconnected ones of the phosphor display elements in response to a minute signal included in the time signal and controlling the voltages to the inner and the outer grids so that the thermoelectrons from the heater are directed to that one of the selected phosphor display elements underlying one of the inner grid segments and that one of the outer grid segments at the same angular position as said one inner grid segment to energize said one display element over its entire length, thereby to provide a long hand display.

6. An analog electronic timepiece according to claim 5, wherein the inner and the outer grids are disposed on the opposite side from the phosphor display elements with respect to the thermoelectron emissive heater.

7. An analog electronic timepiece according to claim 6, wherein the inner and outer grids are formed on a curved surface of the front panel.

8. An analog electronic timepiece according to claim 5, wherein the inner and outer grids are disposed between the thermoelectron emissive heater and the phosphor display elements.

9. An analog electronic timepiece according to claim 8, wherein the inner and outer grids comprise patterns of an electrode material formed on a common insulating support net without closing its meshes.

10. An analog electronic timepiece according to claim 5, wherein the spacing between adjacent ones of the phosphor display elements is larger at the dividing position of the grids than the spacing between the phosphor display elements at other angular positions.

11. An analog electronic timepiece according to claim 10, wherein the difference between the display element spacings at the inner side and the outer side of the display elements at the grid dividing angular position is smaller than the difference in the display element spacing at other angular positions.

* * * * *